US010034592B2

(12) United States Patent
Vrdoljak

(10) Patent No.: US 10,034,592 B2
(45) **Date of Patent: *Jul. 31, 2018**

(54) STEAM CLEANING APPLIANCE WITH VIBRATION AND HEATING COMPONENTS

(71) Applicant: SharkNinja Operating LLC, Newton, MA (US)

(72) Inventor: Ognjen Vrdoljak, Laval (CA)

(73) Assignee: SharkNinja Operating LLC, Needham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/480,596

(22) Filed: Apr. 6, 2017

(65) Prior Publication Data

US 2017/0209017 A1 Jul. 27, 2017

Related U.S. Application Data

(63) Continuation of application No. 13/261,816, filed as application No. PCT/US2012/052480 on Aug. 27, 2012, now Pat. No. 9,615,718.

(Continued)

(51) Int. Cl.

*A47L 11/34* (2006.01)
*A47L 13/22* (2006.01)

(Continued)

(52) U.S. Cl.

CPC ..... *A47L 13/225* (2013.01); *A47L 13/12* (2013.01); *A47L 13/256* (2013.01)

(58) Field of Classification Search

CPC ..... A47L 13/12; A47L 13/256; A47L 13/225; A47L 11/34; A47L 13/22

(Continued)

(56) References Cited

U.S. PATENT DOCUMENTS 7,468,082 B2 12/2008 Gordon
7,996,948 B2 * 8/2011 Kaminer ..... A47L 13/20 15/209.1

(Continued)

FOREIGN PATENT DOCUMENTS

CN 1142869 A 2/1997
CN 1377453 A 10/2002

(Continued)

OTHER PUBLICATIONS

Office Action and Search Report for Chinese Patent Application No. 201280049051.2 dated Dec. 10, 2015.

(Continued)

*Primary Examiner* — David Redding
(74) *Attorney, Agent, or Firm* — Grossman Tucker Perreault & Pfleger, PLLC

(57) ABSTRACT

A steam frame for a steam appliance has a body, a passageway in the body for passage of a fluid medium, and a member such as an unbalanced rotatable turbine in fluid communication with the passageway, where the member is capable of being engaged by the fluid medium to produce vibrations in the body for enhanced cleaning performance. A steam attachment includes a body, a pad covering at least a portion of the body, and a heating element coupled to the body. The heating element and vibration-producing member may be used separately or together.

20 Claims, 7 Drawing Sheets

Related U.S. Application Data

(60) Provisional application No. 61/538,080, filed on Sep. 22, 2011, provisional application No. 61/527,321, filed on Aug. 25, 2011.

(51) Int. Cl.
*A47L 13/12* (2006.01)
*A47L 13/256* (2006.01)

(58) Field of Classification Search
USPC ..... 15/320
See application file for complete search history.

(56) References Cited

U.S. PATENT DOCUMENTS

| | | | | |
|---|---|---|---|---|
| 8,731,384 | B2 | 5/2014 | Cho et al. | |
| 9,615,718 | B2 * | 4/2017 | Vrdoljak | A47L 13/225 |
| 2002/0096201 | A1 | 7/2002 | Shaw et al. | |
| 2003/0137821 | A1 | 7/2003 | Gotoh et al. | |
| 2007/0079470 | A1 | 4/2007 | Rippl | |
| 2008/0066789 | A1 | 3/2008 | Rosenzweig et al. | |
| 2008/0128728 | A1 | 6/2008 | Nemchuk et al. | |
| 2008/0189900 | A1 | 8/2008 | Milanese | |
| 2009/0000051 | A1 | 1/2009 | Rosenzweig et al. | |
| 2009/0190072 | A1 | 7/2009 | Nagata et al. | |
| 2009/0320231 | A1 | 12/2009 | Rosenzweig et al. | |
| 2010/0024146 | A1 | 2/2010 | Rosenzweig et al. | |
| 2010/0050367 | A1 | 3/2010 | Tsai | |
| 2010/0269282 | A1 | 10/2010 | Kaminer et al. | |
| 2010/0272948 | A1 | 10/2010 | Kaminer et al. | |
| 2011/0221998 | A1 | 9/2011 | Adachi et al. | |
| 2012/0180239 | A1 * | 7/2012 | Byrne | A47L 11/26 15/154.2 |
| 2013/0312212 | A1 | 11/2013 | Kowalski | |

FOREIGN PATENT DOCUMENTS

| | | | |
|---|---|---|---|
| CN | 20021386470 | A | 12/2002 |
| CN | 1454329 | A | 11/2003 |
| CN | 20062756150 | Y | 2/2006 |
| CN | 201052124 | A | 4/2008 |
| CN | 201271218 | Y | 7/2009 |
| EP | 0656555 | B1 | 3/2003 |
| TW | 200528780 | A | 9/2005 |
| WO | 199406249 | A1 | 3/1994 |
| WO | 199527915 | A1 | 10/1995 |
| WO | 2009000140 | A1 | 12/2008 |
| WO | 2009082870 | A1 | 7/2009 |
| WO | 2010123512 | A1 | 1/2010 |
| WO | 2010020094 | A1 | 2/2010 |
| WO | 2010031226 | A1 | 3/2010 |
| WO | 2010031256 | A1 | 3/2010 |
| WO | 2010127519 | A1 | 11/2010 |
| WO | 2012058848 | A1 | 5/2012 |
| WO | 2013010341 | A1 | 1/2013 |

OTHER PUBLICATIONS

Written Opinion of the International Searching Authority (Russia) for International Application No. PCT/US2012/052480 dated Dec. 6, 2012.

* cited by examiner

STEAM CLEANING APPLIANCE WITH VIBRATION AND HEATING COMPONENTS

RELATED APPLICATIONS

The present application is a continuation of and claims priority to U.S. Utility patent application Ser. No. 13/261,816 filed Sep. 26, 2014, entitled "Steam Cleaning Appliance with Vibration and Heating Components", which claims priority to PCT Application No. PCT/US12/52480 filed Aug. 27, 2012, entitled "Steam Cleaning Appliance with Vibration and Heating Components", which claims priority to U.S. Provisional Patent Application Nos. 61/538,080, filed Sep. 22, 2011, entitled "Steam Attachment", and 61/527,321, filed Aug. 25, 2011, entitled "Vibrating Steam Frame", all of which are incorporated herein by reference in their entity.

BACKGROUND

The present invention relates to the field of steam appliances, and in particular to steam frames to be used in conjunction with a steam appliance such as a steam mop or a handheld steamer, among others. Examples of steam appliances include those disclosed in U.S. Patent Application Nos. 2009/0320231 and U.S. Patent Application No. 2008/0066789, filed Jun. 27, 2008 and Jun. 27, 2007, respectively.

SUMMARY

In one respect, a vibrating steam frame for a steam appliance such as a steam mop may be effective at cleaning hard to remove stains including the likes of dry tomato stains and/or soy sauce stains, among other types of stains. In some instances, vibrations from the steam frame may mean that less physical or mechanical pressure need to be exerted against the tough to remove stains. This may be helpful for the elderly, the young, or those who need assistance in using a steam appliance for cleaning a floor surface.

In one embodiment, a steam appliance may include a vibrating steam frame having a body, a passageway within the body configured to allow a fluid medium to travel therethrough, and a member in fluid communication with the passageway, where the member is capable of being engaged by the fluid medium to produce vibrations throughout the body. In other words, the vibration may be provided by the steam itself without the need of an additional power supply.

In some embodiments, the body of the steam frame may be rectangular triangular in shape. In other embodiments, the fluid medium may be steam or liquid including water or a cleaning detergent, among others.

In one embodiment, the member of the steam frame includes a first portion having a first mass and a second portion having a second mass, where the second mass is different from the first mass. The difference in mass is able to cause the member to be off-balance so as to cause vibration throughout the body of the steam frame.

In one example, the vibrating member may be a rotatable turbine. In another example, the vibrating member may be a brass impeller. In that instance, the brass impeller may have a diameter in the range of from about 20 mm to about 40 mm, or from about 25 mm to about 35 mm, or from about 20 mm to about 25 mm, or from about 20 mm to about 30 mm, or from about 20 mm to about 35 mm, or from about 25 mm to about 30 mm, or from about 25 mm to about 40 mm.

In one embodiment, the steam frame as described herein may be used in combination with a steam appliance, such as a steam mop.

In one embodiment, a steam attachment for a steam appliance includes a body having an inlet and an outlet, where the inlet is configured to receive a fluid medium from a steam conduit and the outlet is configured to allow the fluid medium to exit. A passageway may exist within the body to allow the fluid medium to travel between the inlet and the outlet.

The steam attachment may include a member in fluid communication with the passageway, where the member is capable of being engaged by the fluid medium to produce vibrations throughout the body.

In one embodiment, the steam attachment may be used in combination with the steam conduit of a steam appliance such as a handheld steamer. The steam appliance may include a housing having a steam generator, and a steam frame in communication with the steam generator. The steam frame may have the same or substantially similar characteristics as those disclosed herein.

In another respect, a steam attachment is disclosed that is capable of providing enhanced cleaning performance via the addition of a thermal element, a vibrational element, or a combination of both thermal and vibrational elements. In general, the steam attachment includes a body, a pad covering at least a portion of the body, and a heating element coupled to the body. The heating element is configured to increase the temperature of the pad for enhanced cleaning performance.

In one embodiment, the steam frame includes an inlet in the body for receiving steam from a steam appliance. In another embodiment, the steam frame includes an outlet in the body for discharging steam, the outlet being substantially covered by the pad.

In some embodiments, the shape of the body of the steam frame can be triangular or rectangular. Similarly, the shape of the pad can be triangular or rectangular.

The steam frame disclosed above can be used in combination with a steam appliance such as the like of a steam mop, among others.

In one embodiment, a steam frame includes a body, a pad covering at least a portion of the body, and an element coupled to the body, the element configured to vibrate the pad for enhanced cleaning performance.

In one embodiment, a steam frame includes a body, a pad covering at least a portion of the body, and at least two elements coupled to the body. The first element is configured to increase the temperature of the pad, while the second element is configured to vibrate the pad. The combination of the two elements are capable of allowing the pad to provide enhanced cleaning performance.

In one embodiment, a steam appliance includes a steam generator, a water tank in fluid communication with the steam generator for supplying water from the water tank to the steam generator, and a steam frame in fluid communication with the steam generator. In some embodiments, the steam frame may be substantially similar to those disclosed herein.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

It will be appreciated by those of ordinary skill in the art that the disclosure can be embodied in other specific forms without departing from the spirit or essential character thereof. The presently disclosed embodiments are therefore considered in all respects to be illustrative and not restrictive.

Figure 1:
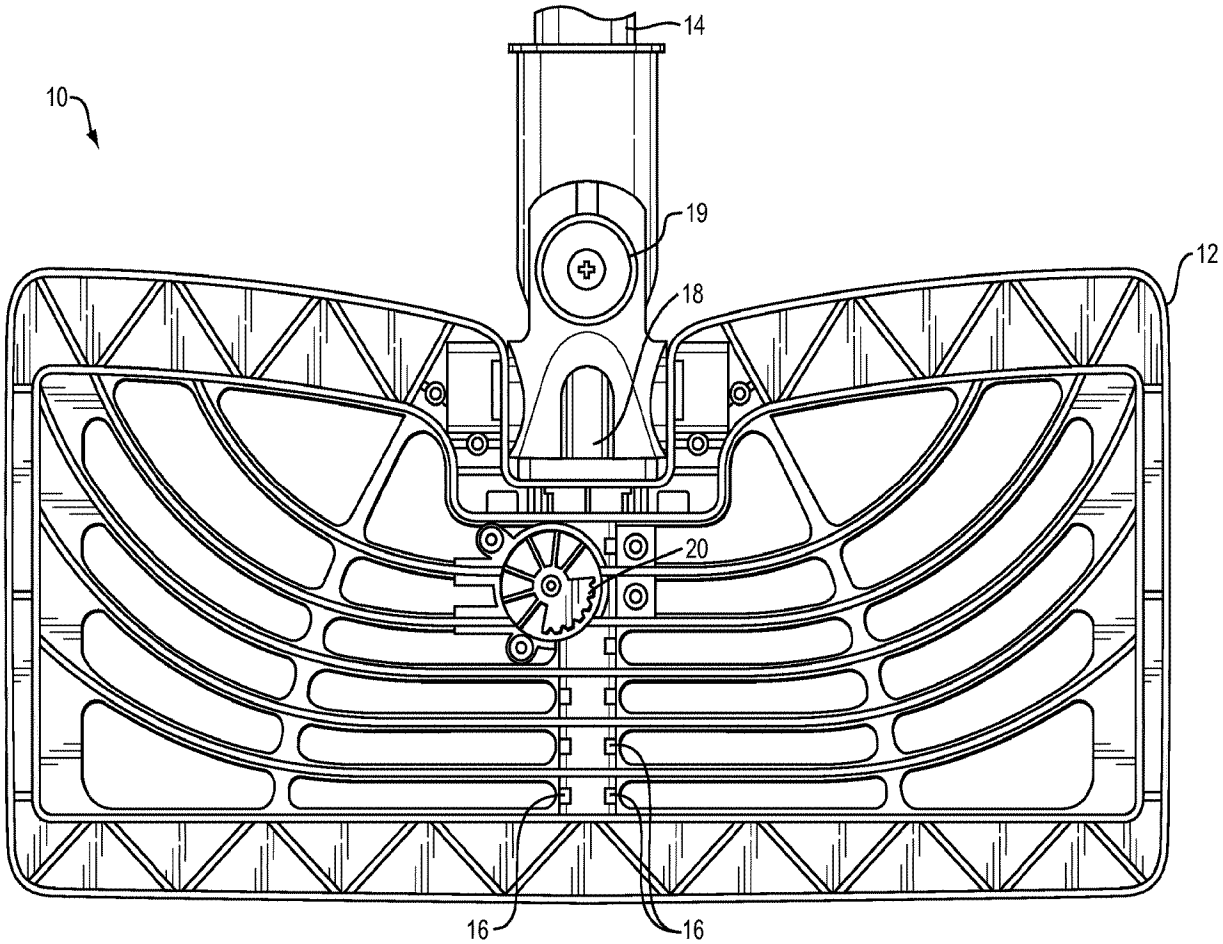
FIG. 1 is a plan view of a steam frame having a vibrating member according to one embodiment of the present disclosure.

FIG. 1 is a perspective view of a steam frame 10 for a steam appliance (not shown) according to one embodiment of the present disclosure. In general, the steam frame 10 may be used in conjunction with a steam appliance such as the likes of a steam mop or a handheld steamer, among others. Examples of steam appliances include those disclosed in U.S. Patent Application Nos. 2009/0320231 and U.S. Patent Application No. 2008/0066789, filed Jun. 27, 2008 and Jun. 27, 2007, respectively, each of which is incorporated herein by reference in its entirety for all purposes.

In one embodiment, the steam frame 10 includes a body 12. The body 12 can generally be made of a plastic material although other types of materials can be contemplated. Within the body 12 is a passageway 18, which is configured to allow a fluid medium to travel therethrough. The types of fluid medium may include steam or liquid such as water. In the alternative, the fluid medium may be a fluid-like cleaning detergent or a liquid mixture, among others.

In one embodiment, the passageway 18 may include an inlet 14 and a plurality of outlets 16. In operation, the fluid medium enters the passageway 18 from the inlet 14 and exits the outlets 16. The steam frame 10 may also include a universal connector 19 that allows for flexible movement including swiveling of the steam frame 10 for cleaning hard to reach places. Although a rectangular steam frame 10 is shown, it will be appreciated by one skilled in the art that the steam frame 10 can take on other polygonal shapes including triangular, square and circular, among others.

In one embodiment, the steam frame 10 includes a member 20, which can be in fluid communication with the passageway 18. In this instance, a portion of the passageway 18 may be removed to accommodate the member 20. In operation, the member 20 is capable of being engaged by the fluid medium to produce vibrations throughout the body 12. In other words, as the fluid medium passes through the passageway 18 at a high velocity, the fluid medium can make contact with and cause the member 20 to rotate. Rotation of the member 20 may cause vibrations which may subsequently be transmitted throughout the body 12 of the steam frame 10. This will be discussed in more detail below.

The inlet 14 of the steam frame 10 may be coupled to a steam generator of a steam appliance for receiving steam or other fluid medium. The steam appliance may include a pole allowing the steam appliance to be used as a steam mop for cleaning a floor surface. Steam received from the inlet 14 may travel through the passageway 18 and exit the outlets 16. In operation, as steam passes through the passageway 18, the velocity of the steam may cause the member 20 to rotate thereby conveying the vibrations from the member 20 throughout the body 12 of the steam frame 10.

Figure 2:
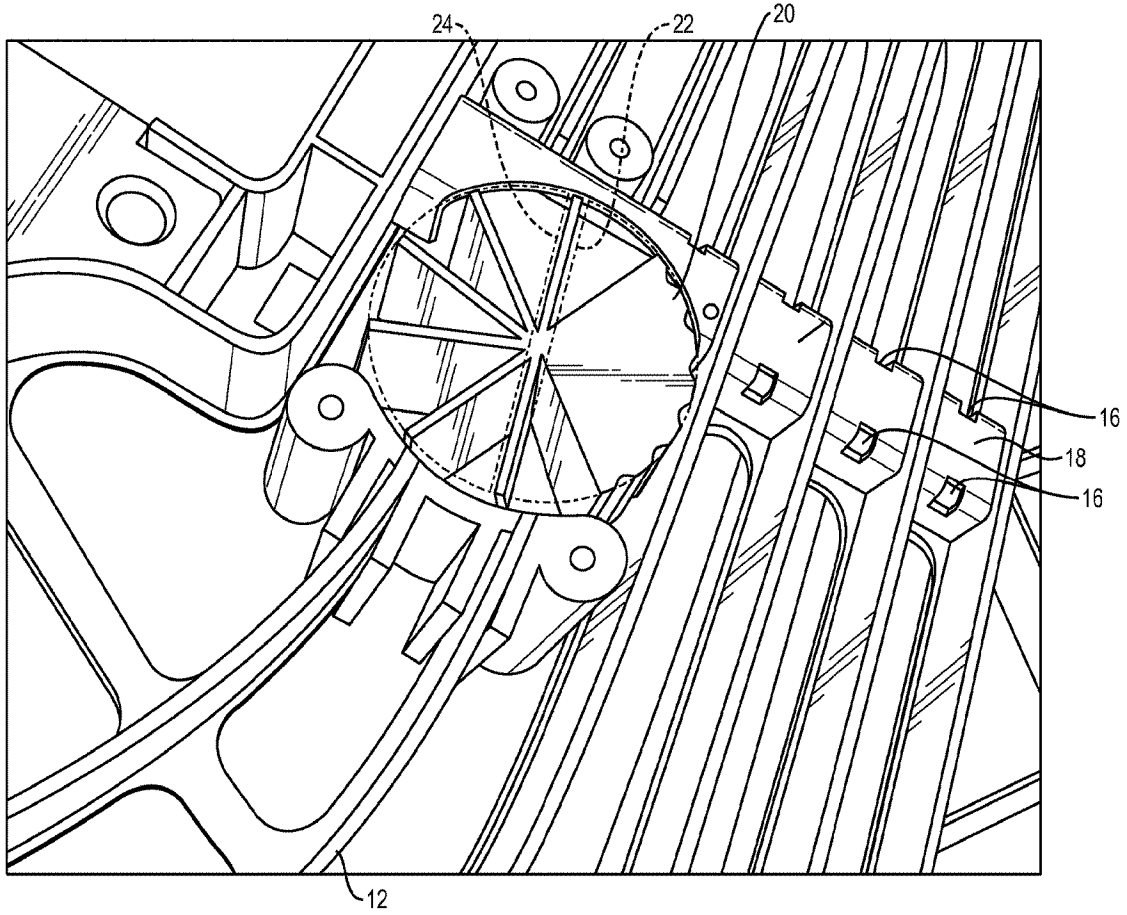
FIG. 2 is a close-up view of the steam frame of FIG. 1.

FIG. 2 is a close-up view of the steam frame 10 of FIG. 1 that better illustrates the vibrating member 20. As shown, the member 20 includes a first portion 22 having a first mass and a second portion 24 having a second mass. The second mass has a different mass and weight than the first mass. The mass and/or weight of the first portion 22 and the second portion 24 may be varied and/or adjusted accordingly to accommodate the shape and/or size of the body 12 of the steam frame 10. In the illustrated example, the first portion 22 includes an extended solid portion, whereas the second portion 24 is limited to a set of relatively thin fins or blades, and therefore the mass of the first portion 22 is greater than the mass of the second portion 24.

In one example, the member 20 is a brass impeller. The brass impeller may have a diameter in the range of from about 20 mm to about 40 mm. In some embodiments, the diameter may be from about 25 mm to about 35 mm, or from about 20 mm to about 25 mm, or from about 20 mm to about 30 mm, or from about 20 mm to about 35 mm, or from about 25 mm to about 30 mm, or from about 25 mm to about 40 mm.

In general, members 20 with smaller diameters may be able to turn faster (e.g., higher revolutions per minute or RPM) with lower vibration amplitude while members 20 with larger diameters may turn slower (e.g., lower RPM) with higher vibration amplitude. In other instances, the member 20 may be a rotatable turbine that may function in a substantially similar manner.

In general, the variation in mass may cause an imbalance in the member 20 such that when agitated by the fluid medium the member 20 may rotate and vibrate. As described above, the member 20 may be a small turbine or a rotatable impeller. In one instance, the rotation or oscillation may be caused by the steam passing through the passageway 18. The speed and velocity of the steam may further dictate the rotational speed of the member 20. In other words, the higher the steam velocity, the faster and higher the RPM of the member 20. The rotation or oscillation of the member 20 may create enough momentum so as to pass the vibrate throughout the body 12 of the steam frame 10. The vibration of the steam frame 10 may improve the cleaning capability of the steam frame 10. In addition, the vibration of the steam frame 10 may further reduce the amount of force that needs to be applied on tough to remove stains.

In one embodiment, it is contemplated that a portion of the passageway 18 may be removed to accommodate a section of the member 20. In other embodiments, a portion of the passageway 18 may be integrally coupled to the member 20.

It will be appreciated by one skilled in the art that as the member 20 spins or rotates, the portion of the member 20 within the passageway 18 alternates between the first portion 22 and the second portion 24. The alternating portions 22, 24 may bring about an off-balance vibration of the member 20 thereby dissipating the oscillation within the member 20 throughout the body 12 of the steam frame 10.

Although the member 20 as constructed can be made of brass and in the form of an impeller or turbine, it will be appreciated by one skilled in the art that the member 20 can be made of other suitable materials including the likes of aluminum, zinc and copper, among others. Furthermore, the size and weight of the member 20 may be varied and/or adjusted as appropriate to accommodate the size of the steam frame 10. In addition, although the first portion 22 of the member 20 as shown includes fin-like structures while the second portion 24 of the member 20 as shown is mostly a solid block, it will be appreciated by one skilled in the art that the portions 22, 24 can be varied to provide different amounts of vibration and/or agitation as necessary. Furthermore, more than two portions 22, 24 may be contemplated within the vibrating member 20.

In one embodiment, a vibrating member 20 may be incorporated within a steam attachment. The steam attachment may include a body having an inlet and an outlet, where the inlet is configured to receive a fluid medium from a steam conduit and the outlet is configured to allow the fluid medium to exit. The steam conduit may be a part of a handheld steam unit as disclosed in one or more of the published applications discussed herein. In one embodiment, the steam conduit may be a steam hose while the steam attachment may be a steam attachment unit coupleable to the end of the steam hose.

In one embodiment, the steam attachment includes a passageway within the body configured to allow the fluid medium to travel between the inlet and the outlet, and a vibrating member in fluid communication with the passageway, where the member is capable of being engaged by the fluid medium to produce vibrations throughout the body. The vibrating member may have characteristics substantially similar to those described herein.

In some embodiments, the steam attachment may be provided in combination with the steam conduit. In other embodiments, the steam attachment may be provided in combination with the steam conduit and a steam appliance such as the likes of a handheld steamer, among others.

In one embodiment, a steam appliance includes a housing having a steam generator and a steam frame in communication with the steam generator. The steam appliance may be a steam mop or a handheld steamer similar to those described above. The steam frame in communication with the steam generator may have characteristics substantially similar to those discussed herein.

Figure 3:
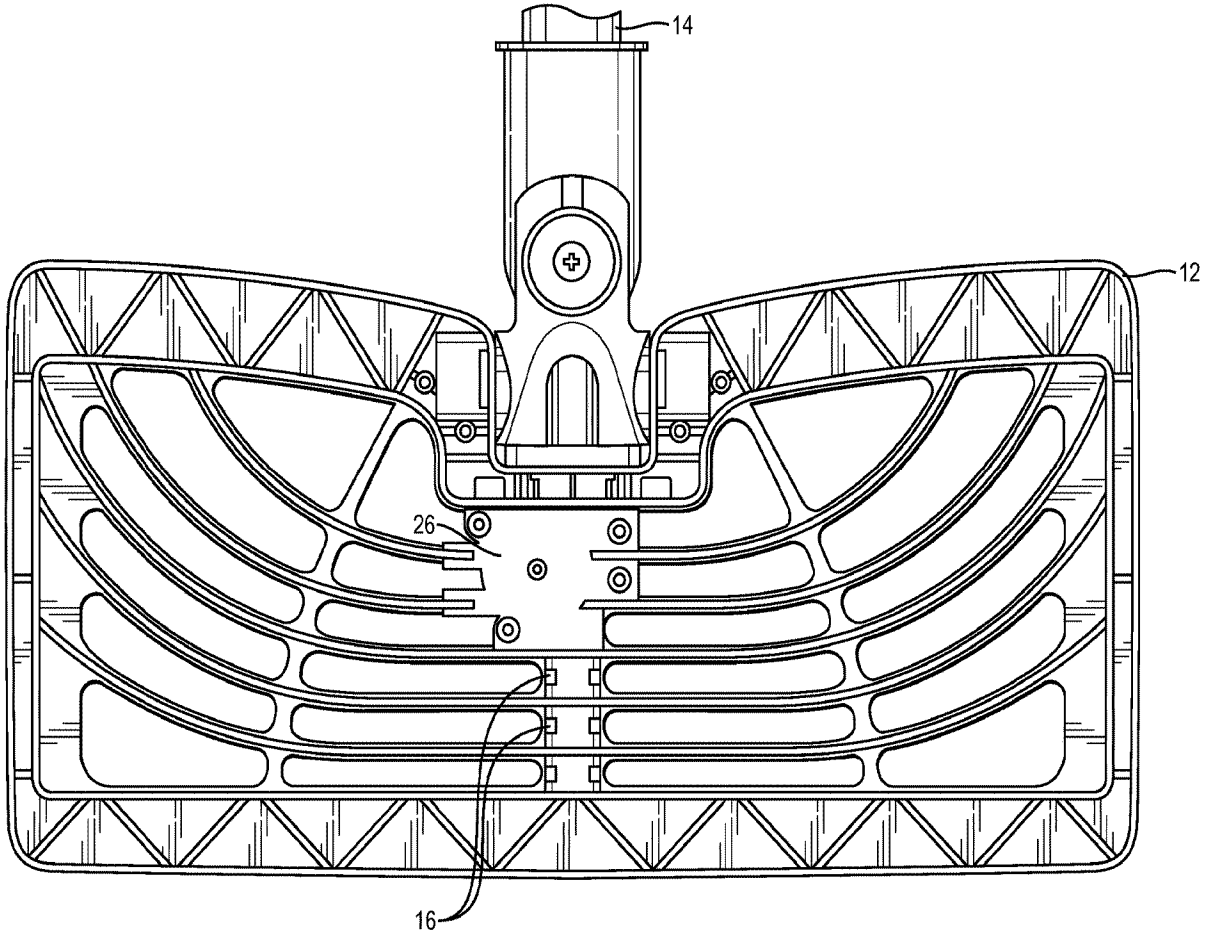
FIG. 3 is a plan view of the steam frame of FIG. 1 where the vibrating member is covered.

FIG. 3 is a top-down view of the steam frame 10 of FIG. 1 with the vibrating member 20 being covered by a plastic housing 26. The coverage may be permanent or detachable to make repairs and/or modifications as necessary. In some embodiments, the steam frame 10 may be used like a steam pocket including the likes of those disclosed in U.S. Patent Application Nos. 2010/0269282 and 2010/0272948, each of which is filed May 15, 2009 and incorporated herein by reference in its entirety for all purposes.

In some embodiments, once the member 20 has been covered, the steam frame 10 may be used in conjunction with a pad or fabric material to facilitate its use on a floor surface. Examples of steam pads or materials/layers suitable for serving as a cover for the steam frame 10 include those disclosed in U.S. Patent Application Nos. 2009/0000051 and 2010/0024146, filed Mar. 7, 2008 and Aug. 4, 2008, respectively, each of which is incorporated herein by reference in its entirety for all purposes.

Figure 4:
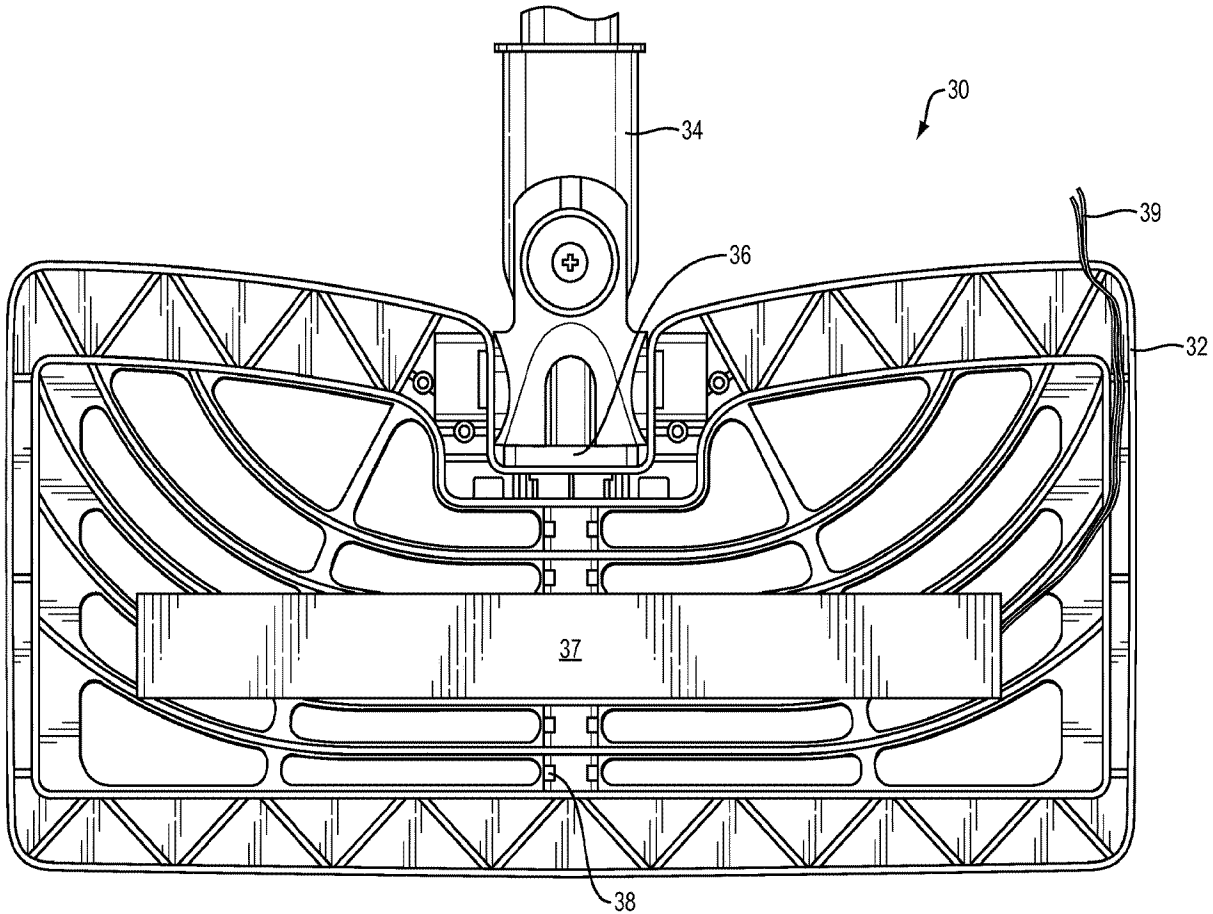
FIG. 4 is a plan view of a steam attachment according to one embodiment of the present disclosure.

FIG. 4 is a top-down view of a steam attachment 30 according to another embodiment of the present disclosure. For example, the steam attachment 30 may be a steam frame 30 that can be attached to one end of a steam appliance such as a steam mop.

Examples of steam appliances include those disclosed in U.S. Patent Application Nos. 2009/0320231 and U.S. Patent Application No. 2008/0066789, filed Jun. 27, 2008 and Jun. 27, 2007, respectively, each of which is incorporated herein by reference in its entirety for all purposes.

Examples of steam attachments include the likes of those disclosed in U.S. Patent Application Nos. 2010/0269282 and 2010/0272948, each of which is filed May 15, 2009 and incorporated herein by reference in its entirety for all purposes.

In one embodiment, the steam frame 30 includes a body 32 and a pad (not shown) covering at least a portion of the body 32. The pad may be a cloth-like cover for the steam frame 30. The figure does not show the pad to provide more detail on the internal make-up of the steam frame 32.

Examples of steam pads or materials/layers suitable for serving as a cover for the steam frame 30 include those disclosed in U.S. Patent Application Nos. 2009/0000051 and 2010/0024146, filed Mar. 7, 2008 and Aug. 4, 2008, respectively, each of which is incorporated herein by reference in its entirety for all purposes.

As shown in the figure, the steam frame 30 includes a flexible conduit or connector 34 for coupling to a steam appliance. Steam is capable of entering the steam frame 30 from an inlet 36, travel through a central conduit, and exit from a plurality of outlets 38. Although a single central conduit is shown, it will be appreciated by one skilled in the art that steam can travel through various conduits via a variety of pathways. In operation, in one embodiment, the pad can be slipped over the entire exterior of the body 32 thereby substantially covering the outlets 38.

In one embodiment, the steam frame 30 includes a heating element 37 coupled to a portion of the body 32. The heating element 37 can be a heating element capable of increasing the temperature of the body 32 as well as the temperature of the pad to deliver enhanced cleaning performance. It will be appreciated by one skilled in the art that the heat from the heating element 37 can be provided to one side or both sides of the steam frame 30.

In some embodiments, the heating element 37 is capable of providing from about 90 W of power to about 130 W of power. In other embodiments, the heating element 37 has an operating temperature of from about 135° C. to about 150° C. Although shown as substantially rectangular, the heating element 37 can take on a plurality of polygonal shapes including circular and square, among others. Additionally, the heating element 37 can be embedded about the exterior portions of the body 32.

Power for the heating element 37 can be provided via an electrical outlet 39, the electrical outlet 39 capable of being routed through the connector 34. In the alternative, power for the heating element 37 can be provided by a battery (not shown). Furthermore, the steam frame 30 or the steam mop may include an on/off trigger or a motion sensor for disabling the heating element 37 when the steam mop is stationary or not being used. In other words, the steam mop will automatically turn off the heating element 37 when the steam mop is stationary or not in operation. Alternatively, a user may manually turn on/off the heating element 37 as necessary depending on the cleaning performance of the pad on a floor surface.

As shown, the shape of the body 32 of the steam frame 30 is substantially rectangular. It will be appreciated by one skilled in the art that the body 32 can take on other polygonal shapes including triangular and circular, among others. Similarly, the pad can take on other polygonal shapes corresponding to that of the steam frame 30.

In one embodiment, the steam appliance such as a steam mop may utilize the steam frame 30 embodiments disclosed herein. The steam mop includes a housing having a steam generator, a water tank in fluid communication with the steam generator for supplying water from the water tank to the steam generator. And a steam frame 30 according to those disclosed herein in fluid communication with the housing and the steam generator, the steam frame 30 including a body 32 having an outlet 38 for discharging steam, a pad covering at least a portion of the outlet 38, and a heating element 37 coupled to the body 32, the heating element 37 configured to increase the temperature of the pad for enhanced cleaning performance.

Figure 5:
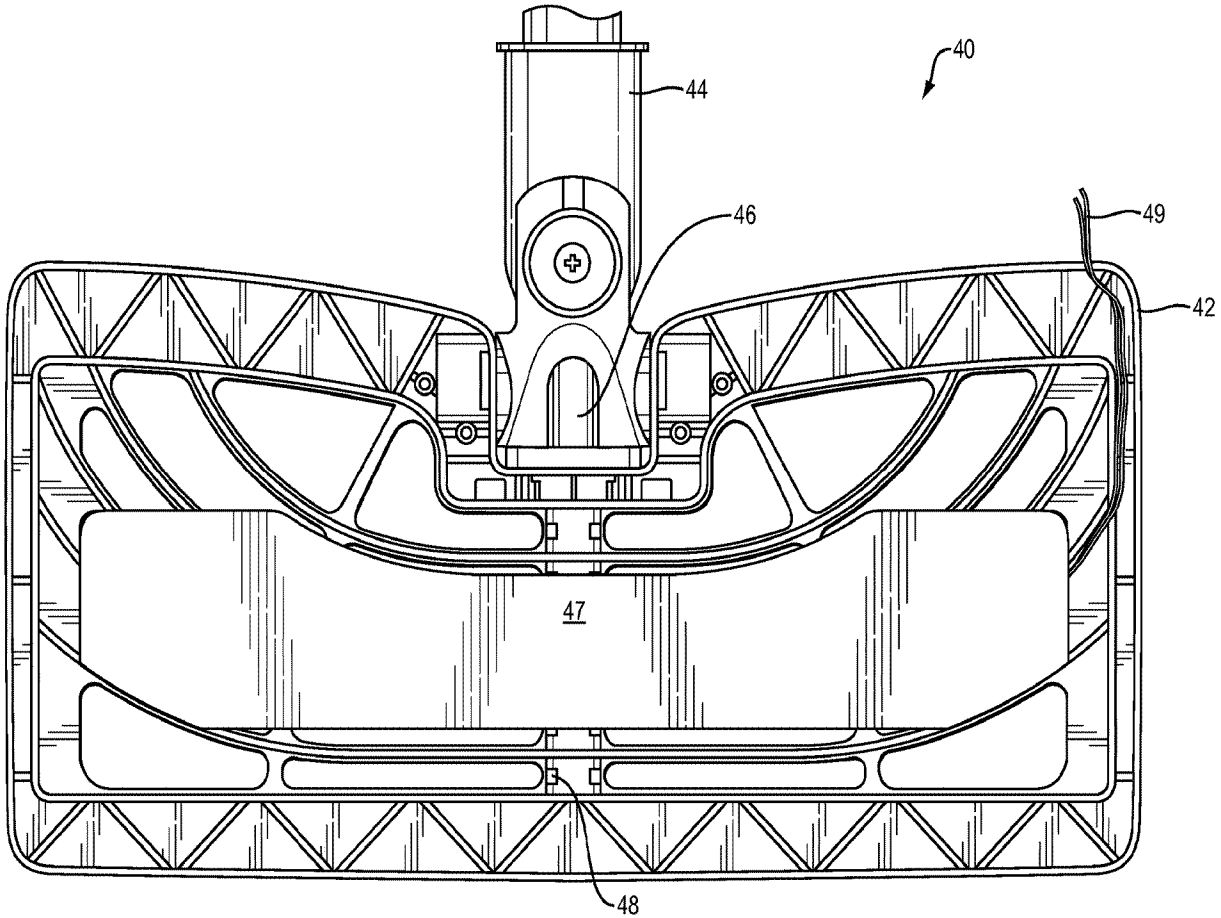
FIG. 5 is a plan view of a steam attachment according to one embodiment of the present disclosure.

FIG. 5 is a top-down view of a steam attachment 40 according to another embodiment of the present disclosure. Like above, the steam attachment 40 includes a body portion 42 with a connector 44 to a steam appliance (not shown) such as a steam mop. The steam frame 40 further includes an inlet 46 and an outlet 48 for receiving and discharging steam from a steam generator of the steam appliance. In this embodiment, the heating element 47 is a heating plate that can be attached to the body 42 using glue or other suitable fasteners.

In some embodiments, the heating element 47 can be embedded in the body 42 of the steam attachment 40 via alternative fastening mechanisms including nuts, bolts and rivets, among others. In other embodiments, the heating element 47 can be integrally formed with the body 42, e.g., the body 42 and the heating element 47 can both be made of the same material such as aluminum or copper, among other suitable metals.

In operation, a pad covering a steam frame without the embedded heating element can clean a stain (e.g., tomato, soy sauce) in about 26 strokes with a pad temperature ranging from about 60° C. to about 70° C. In contrast, a pad covering a steam frame using the presently disclosed embedded heating element can clean the same stain in about 21 strokes with a pad temperature ranging from about 70° C. to about 80° C. The additional heat from the heating element allows the stain to be removed easier from the floor surface. The additional heat can be carried by the pad for making contact with the stain, the increased temperature allowing the stain to be easier dissolved or dissociated from the floor surface.

From above, the cleaning performance can be at about 20% (e.g., 5 stroke improvement from 26 strokes). In some embodiments, the cleaning improvement can be greater than about 20%, or greater than about 25%, or greater than about 30%, or greater than about 35%, or greater than about 40%, or greater than about 50%. In other embodiments, the cleaning improvement can be about 10%, or from about 10% to about 20%, or from about 15% to about 20%.

Similarly, the increase in pad temperature can be at about 10° C. (e.g., from 60-70° C. to 70-80° C.). In some embodiments, the increase in temperature can be greater than about 15° C., or greater than about 20° C., or greater than about 25° C., or greater than about 30° C., or greater than about 40° C., or greater than about 50° C. In other embodiments, the increase in temperature can be from about 10° C. to about 20° C., or from about 15° C. to about 20° C.

Figure 6:
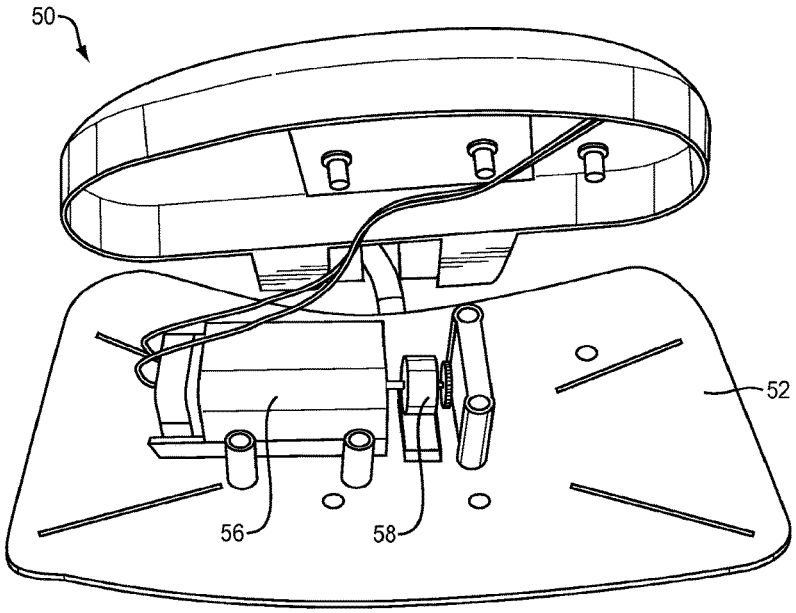
FIG. 6 is a perspective view of a steam attachment according to one embodiment of the present disclosure.

FIG. 6 is a perspective view of a steam attachment 50 according to one embodiment of the present disclosure. The steam frame 50 includes a body 52 and a pad (not shown) covering at least a portion of the body 52. In this instance, the pad covers the bottom portion of the body 52, the pad to be used for cleaning a floor surface (e.g., hardwood floor, tile).

In one embodiment, the steam frame 50 includes an element 56 coupled to the body 52, the element 56 configured to vibrate the pad for enhanced cleaning performance. For example, the element 56 may be a single motor having an offset mass capable of rotating in a vertical direction centrally located on the body 52. The offset mass may be driven by a motorized gear 58. In one example, the motor can operate at 24 W or up to 100 W. The motor can rotate at 11,500 RPM with torque of about 19 milli-Nm (newton-meter).

Like above, the steam frame 50 may include an inlet (not shown) in the body 52 for receiving steam from a steam appliance. Similarly, the steam frame 50 may include an outlet (not shown) in the body 52 for discharging steam, the outlet being substantially covered by the pad.

And like above, the shape of the body 52 of the steam frame 50, and the corresponding pad, can be rectangular or triangular. In the alternative, the shape of the body 52 of the steam frame, and the corresponding pad, can take on other polygonal shapes.

Figure 7:
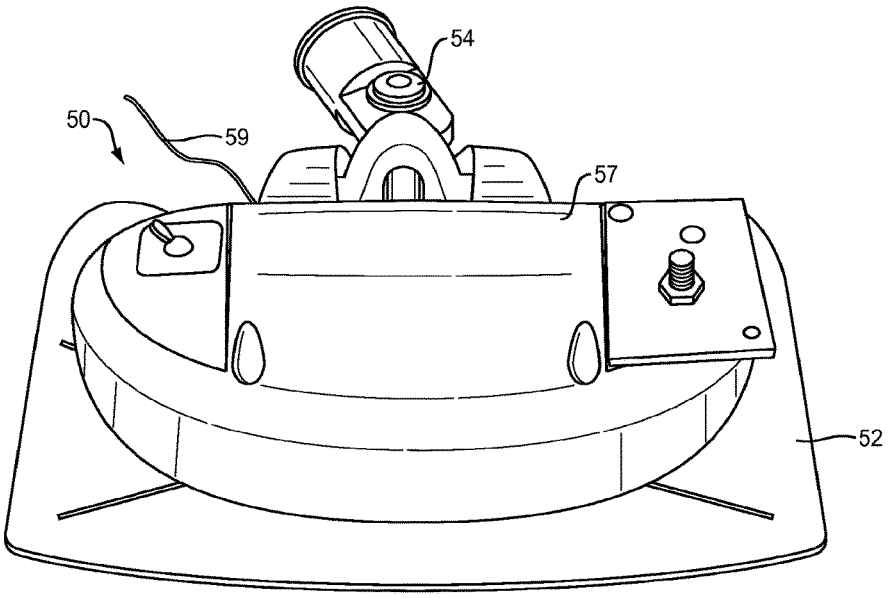
FIG. 7 is a perspective view of the steam attachment of FIG. 6 having a cover.

FIG. 7 is a perspective view of the steam attachment 50 of FIG. 6, where the vibrational element 56 is protected by a cover 57. As shown in this figure, the steam frame 50 includes a connector 54 for coupling the steam frame 50 to a steam appliance such as a steam mop. Power for the vibrational element 56 can be provided via an electrical outlet 59. Although shown to the side, the electrical outlet 59 can be integrated to pass through the connector 54.

In one embodiment, the steam appliance such as a steam mop may utilize the steam frame 50 embodiments disclosed herein. The steam mop includes a housing having a steam generator, a water tank in fluid communication with the steam generator for supplying water from the water tank to the steam generator. And a steam frame 50 according to those disclosed herein in fluid communication with the housing and the steam generator, the steam frame 50 including a body 52 having an outlet for discharging steam, a pad covering at least a portion of the outlet, and an element 56 coupled to the body 52, the element 56 configured to vibrate the pad for enhanced cleaning performance.

The presently disclosed steam frame 50 may provide performance improvement of about 35% to about 50%. In other words, if a stain takes about 30 strokes to remove, the vibrational element allows the stain to be removed at anywhere from about 15 to about 20 strokes thereby reducing the number of strokes by about 10 strokes to about 15 strokes. The improved cleaning capability allows the floor surface to be cleaned faster than using a steam frame without the vibrational element.

Figure 8:
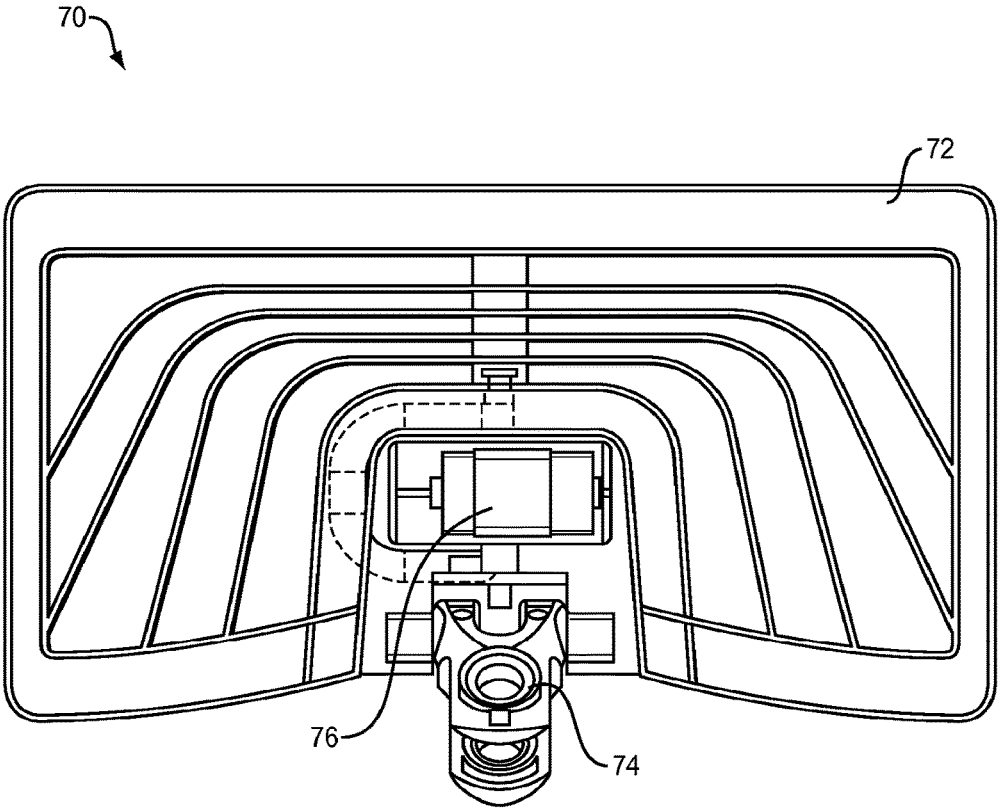
FIG. 8 is a plan view of a steam attachment according to one embodiment of the present disclosure.

FIG. 8 is a schematic view of a steam attachment 70 according to one embodiment of the present disclosure. In this example, the steam attachment 70 is a steam frame 70 having a body 72 coupleable to a connector 74. A vibrational element 76, instead of being disposed on or in the body 72, can rather be incorporated within the connector 74. Furthermore, instead of being coupleable or removably detachable, the vibrational element 76 may be integrated or permanently attached to the connector 74. In some embodiments, a manual on/off trigger may be located on the handle portion for controlling the vibrational element 76. In the alternative, the vibrational element 76 can automatically turn on/off by merely turning on/off the steam appliance.

The presently disclosed steam attachment may be used independently or in combination with each other to provide enhanced cleaning performance. In other words, the steam attachment may be purely thermal, or purely vibrational, or a combination of both.

In one embodiment, a steam frame includes a body, a pad covering at least a portion of the body, a first element coupled to the body, where the first element is configured to increase the temperature of the pad, and a second element coupled to the body, where the second element is configured to vibrate the pad. The two elements are capable of allowing the pad to provide enhanced cleaning performance.

In one embodiment, a steam appliance includes a steam generator, a water tank in fluid communication with the steam generator for supplying water from the water tank to the steam generator, and a steam frame in fluid communication with the steam generator. In this embodiment, the steam frame includes a body, a pad covering at least a portion of the body, a first element coupled to the body, where the first element is configured to increase the temperature of the pad, and a second element coupled to the body, where the second element is configured to vibrate the pad. The two elements are capable of allowing the pad to provide enhanced cleaning performance.

While various embodiments of the invention have been particularly shown and described, it will be understood by those skilled in the art that various changes in form and details may be made therein without departing from the spirit and scope of the invention as defined by the appended claims.

What is claimed is:

1. A steam frame, comprising:

a body having a face portion configured to abut a surface to be cleaned, the body including a passageway for conducting steam from an inlet to one or more outlets on the face portion for discharging the steam during operation; and a vibratory member in fluid communication with the passageway, the vibratory member being arranged and configured to receive a flow of the steam to produce mechanical vibration of the body for increased cleaning effect on the surface during operation.

2. The steam frame of claim 1, wherein the body is substantially planar and symmetric about a central portion where the inlet is located, and wherein the vibratory member is located in the central portion and is in fluid communication with the passageway at a point upstream of at least some of the outlets.

3. The steam frame of claim 2, wherein the vibratory member is located beside the passageway and has an outer portion extending into the passageway to interact with the fluid flow to produce the mechanical vibration of the body.

4. The steam frame of claim 3, wherein the vibratory member includes an unbalanced rotatable member having one or more paddle-like surfaces on which the fluid flow impinges to rotate the vibratory member.

5. The steam frame of claim 4, wherein the vibratory member includes a solid block portion and a separate bladed portion having a set of radially extending blades providing the paddle-like surfaces, the solid block and bladed portions being of unequal masses to produce desired imbalance of the rotatable member.

6. The steam frame of claim 1, wherein the vibratory member includes an unbalanced member including a first portion having a first mass and a second portion having a second mass different from the first mass.

7. The steam frame of claim 1, wherein the vibratory member includes a turbine.

8. The steam frame of claim 1, wherein the vibratory member includes an impeller having a diameter in the range of from about 20 mm to about 40 mm.

9. The steam frame of claim 1, in combination with a steam appliance having a steam outlet coupled to the inlet to provide the steam during operation.

10. The steam frame and the steam appliance combination of claim 9, wherein the steam appliance is a steam mop.

11. The steam frame and the steam appliance combination of claim 9, wherein the steam appliance is a handheld steamer.

12. A steam appliance, comprising:

a steam generator;

a water tank in fluid communication with the steam generator for supplying water from the water tank to the steam generator; and a steam frame in fluid communication with the steam generator, the steam frame having:

a body having an outlet for discharging steam;

a pad covering at least a portion of the outlet; and a vibratory element coupled to the body, the vibratory element configured to vibrate the pad, wherein the vibratory member includes at least one of a turbine or an impeller.

13. The steam appliance of claim 12, wherein the vibratory member includes a solid block portion and a separate bladed portion having a set of radially extending blades providing paddle-like surfaces, the solid block and bladed portions being of unequal masses to produce an imbalance of the vibratory member.

14. The steam appliance of claim 12, wherein the vibratory member includes an unbalanced member including a first portion having a first mass and a second portion having a second mass, the second mass different from the first mass.

15. The steam appliance of claim 12, wherein the vibratory member includes the turbine.

16. The steam appliance of claim 12, wherein the vibratory member includes the impeller.

17. A steam appliance comprising:

a steam generator;

a water tank in fluid communication with the steam generator for supplying water from the water tank to the steam generator; and a steam frame in fluid communication with the steam generator, the steam frame having:

a body;

a pad covering at least a portion of the body;

a heating element coupled to the body, the heating element configured to increase the temperature of the pad; and a vibratory element coupled to the body, the vibratory element configured to vibrate the pad.

18. The steam appliance of claim 17, wherein the vibratory member includes an unbalanced member including a first portion having a first mass and a second portion having a second mass, the second mass different from the first mass.

19. The steam appliance of claim 17, wherein the vibratory member includes a turbine.

20. The steam appliance of claim 17, wherein the vibratory member includes an impeller.

* * * * *